US005144540A

United States Patent [19]

Hayes

[11] Patent Number: 5,144,540

[45] Date of Patent: Sep. 1, 1992

[54] DECORATIVE OUTDOOR LIGHT FIXTURE

[76] Inventor: Lance E. Hayes, 324 Hillsmere Dr., Annapolis, Md. 21403

[21] Appl. No.: 807,230

[22] Filed: Dec. 16, 1991

[51] Int. Cl.[5] ..... F21V 17/00

[52] U.S. Cl. ..... 362/268; 362/455; 362/293

[58] Field of Search ..... 362/169, 268, 455, 293

[56] References Cited

U.S. PATENT DOCUMENTS 3,539,798 11/1970 Perry ..... 362/268

3,764,058 9/1956 Ellis ..... 362/268

*Primary Examiner*—Carroll B. Dority

*Attorney, Agent, or Firm*—Brady, O'Boyle & Gates

[57] ABSTRACT

A decorative outdoor light fixture has an upwardly facing light source mounted in a pipe coupling substantially at or somewhat above ground level. The light source extends into a vertically extending nipple having a pipe union threadably mounted on the top thereof for securing a selected light filter and lens assembly to the upper end of the nipple. Each light filter and lens assembly emits a particular colored decorative light effect to the surrounding atmosphere, and each includes a top hemispherical lens.

16 Claims, 4 Drawing Sheets

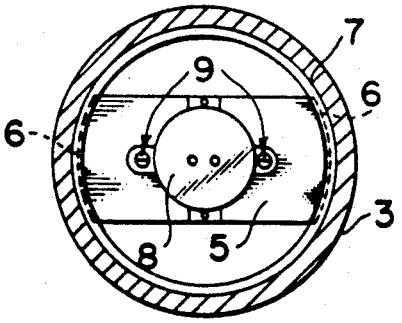
FIG. 4
FIG. 5
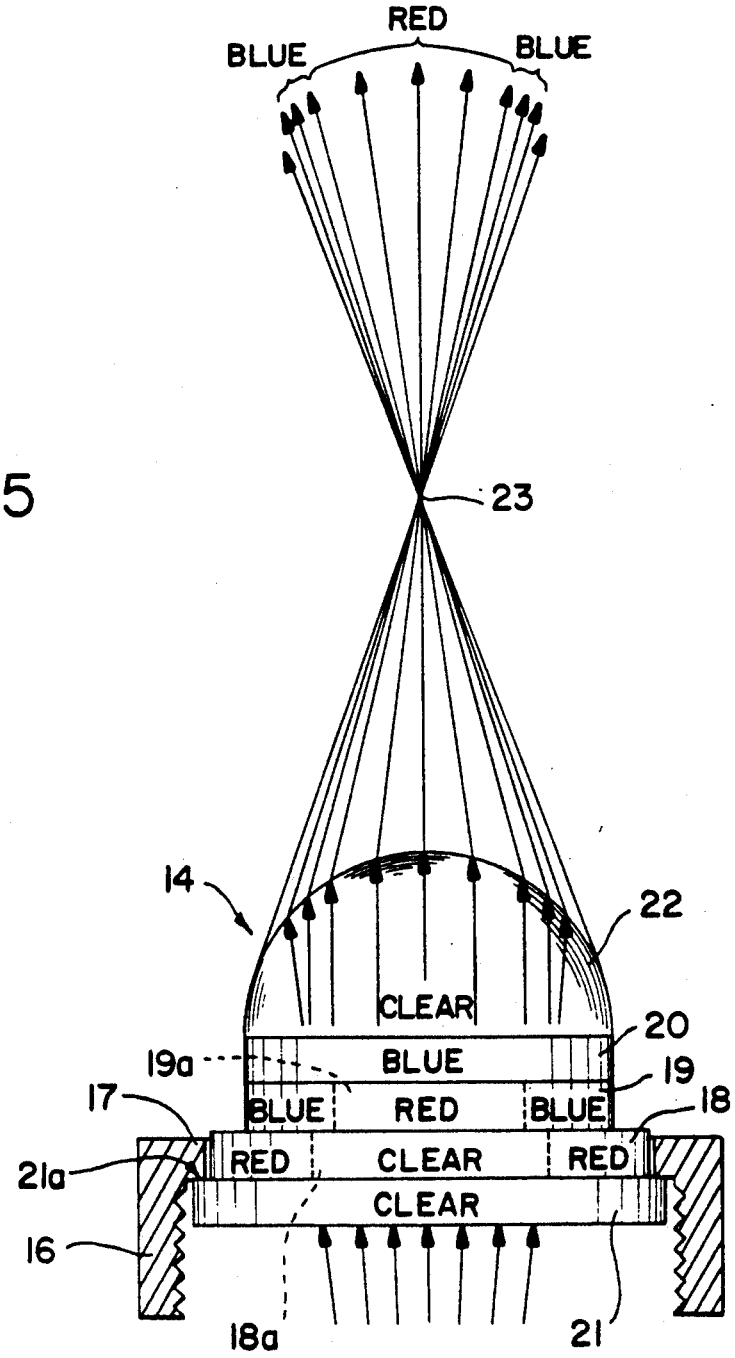

DECORATIVE OUTDOOR LIGHT FIXTURE

BACKGROUND OF THE INVENTION

Various outdoor, ground supported light fixtures have been proposed, such as traffic guide signals as disclosed in U.S. Pat. No. 1,267,967, dated May 28, 1918; airfield markers disclosed in U.S. Pat. No. 4,912,610, dated Mar. 27, 1990; and decorative type disclosed in U.S. Pat. No. 4,930,055, dated May 29, 1990.

The traffic guide signal disclosed in U.S. Pat. No. 1,267,967 includes a lamp mounted beneath ground level below a red colored convex glass lens mounted at ground level, whereby a red light is shown upwardly into the atmosphere.

The airfield marker disclosed in U.S. Pat. No. 4,912,610 includes a light source mounted below ground level which shines light rays through a colored filter positioned above the light source but below ground level, the colored light shining upwardly into the atmosphere through a transparent cover plate mounted at ground level.

The decorative light in U.S. Pat. No. 4,930,055 includes a lamp mounted on the top of a post adapted to be stuck into the ground, the lamp including a transparent tube enclosing light bulbs which produce decorative halos on the transparent tube.

While all of the above noted ground supported light fixtures are satisfactory for their intended purpose, they are limited in that the colored filters, lenses and other components are not readily changeable on the ground supported light fixture, whereby various decorative colored light effects can not be imparted to the ambient atmosphere.

SUMMARY OF THE INVENTION

The decorative outdoor light fixture of the present invention comprises, essentially, an upwardly facing light source mounted in a pipe coupling substantially at ground level supported on a ground stake.

The light source extends into a vertically extending nipple having a pipe union threadably mounted thereon for securing a selected light filter and lens assembly to the upper end of the nipple. One embodiment of the light filter and lens assembly includes a laminate structure of complementary colored discs mounted in a stacked array between a transparent disc and a transparent hemispherical lens. In another embodiment the light filter and lens assembly includes a transparent tube having a laminate structure of complementary colored discs and a transparent disc fixed to one end thereof and a laminate structure of a centrally apertured mirrored convex disc, a stack of complementary colored discs, and a transparent hemispherical lens fixed to the opposite end thereof. In yet another embodiment the light filter and lens assembly includes a solid, transparent, cylinder having a laminate structure of a clear or transparent disc and a complementary colored disc fixed to one end thereof, and a laminate structure of complementary colored discs and a transparent hemispherical lens fixed to the opposite upper end thereof.

Each light filter and lens assembly emits a particular colored decorative light effect, and by the construction and arrangement of the light filter and lens assemblies they can each be selectively secured to the end of the nipple containing the light source, by the pipe union, to thereby provide a selected decorative light effect to the surrounding atmosphere.

BRIEF DESCRIPTION OF THE DRAWINGS

FIG. 4 is a cross-sectional view taken along line 4—4 of FIG. 1;

FIG. 5 is a diagrammatic view of the colored light rays emitting through the light filter and lens assembly of FIG. 1;

DESCRIPTION OF THE PREFERRED EMBODIMENTS

Figure 1:
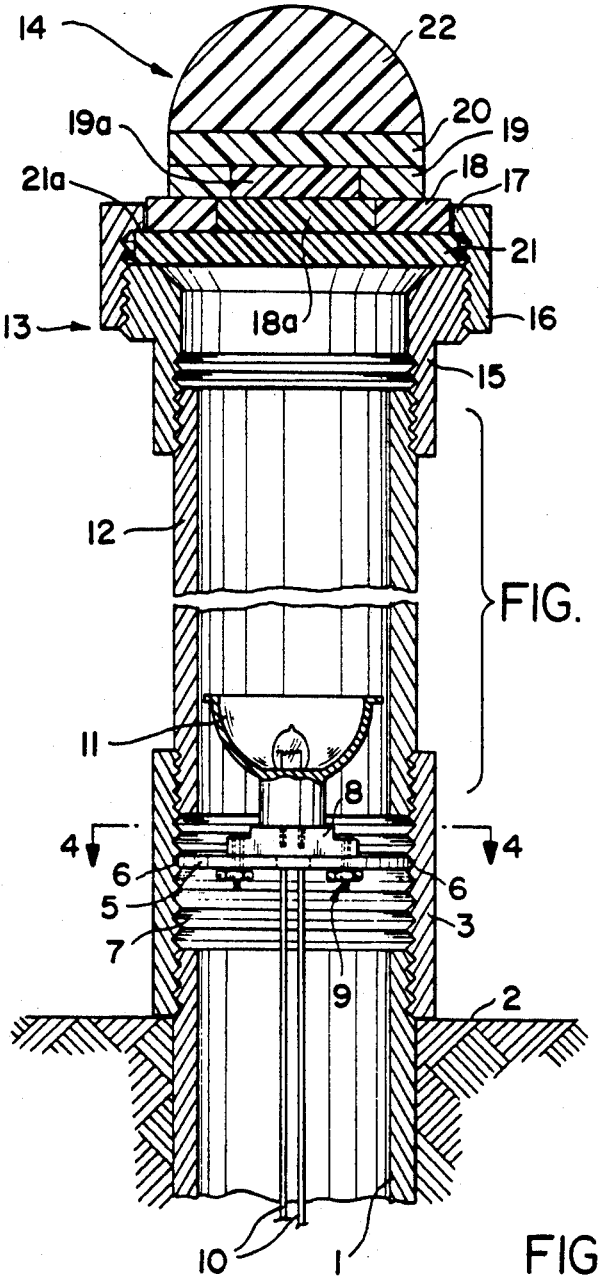
FIG. 1 is a foreshortened, vertical sectional view of the outdoor light fixture of the present invention illustrating one embodiment of the decorative light filter and lens assembly.
Figure 2:
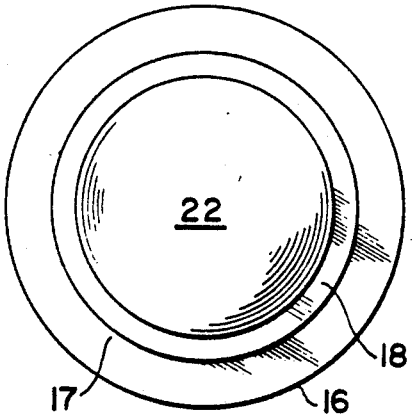
FIG. 2 is a top plan view of the fixture and lens assembly shown in FIG. 1.

Referring to the drawings and more particularly to FIG. 1, the decorative outdoor light fixture of the present invention comprises, an electrical conduit pipe or hollow pipe stake 1, embedded in and extending upwardly from the ground 2 and having a pipe coupling 3 threadably mounted to the exposed end thereof. As will be seen in FIGS. 1 and 4, a transversely extending plate 5 is mounted in the pipe coupling 3, each end of the plate having a tongue portion 6 cooperating with the thread grooves 7 in the coupling 3, whereby the plate is adjustably mounted within the coupling. A socket 8 is secured to the mounting plate 5 by screw and nut assemblies 9, or the like. Electrical conductors 10 extend through the pipe or stake 1 and have their opposite ends connected to a power supply and to the socket 8, respectively. An upwardly facing integral lamp and reflector 11, such as a MR type lamp, is electrically connected into the socket 8 and extends into a nipple 12 having its lower end threadably connected to the upper part of coupling 3. A pipe union 13 is threadably mounted on the upper end of the nipple 12 for securing a selected decorative light filter and lens assembly 14 thereto.

Figure 3:
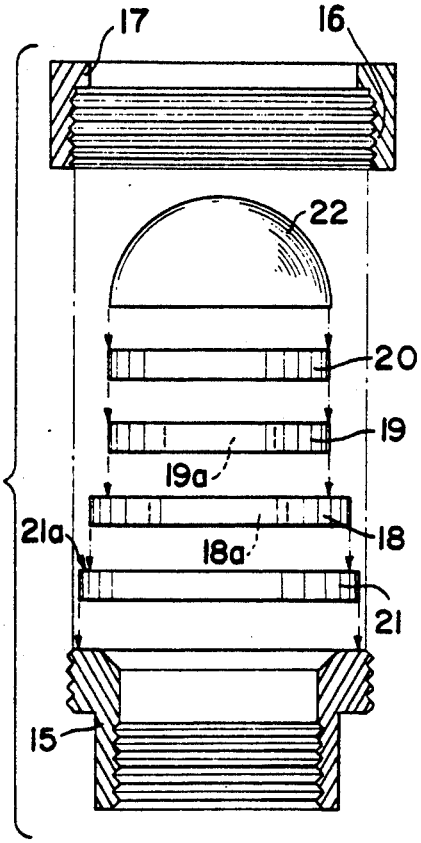
FIG. 3 is an exploded, sectional view of the light filter and lens assembly of FIG. 1.

As will be seen in FIGS. 1 and 3, the pipe union 13 comprises an adaptor 15 threadably mounted to the end of the nipple 12, and a collar 16 having a radially inwardly turned upper flange portion 17 threadably connected to the outer threads on the upper end of adaptor 15.

The decorative light filter and lens assembly 14 comprises, a laminate structure of complementary colored discs 18, 19 and 20 mounted in a stacked array between a clear transparent disc 21 and a clear transparent hemispherical lens 22. Clear transparent disc 21 is larger in diameter than the other discs, and fits beneath flange portion 17 which secures the entire assembly 14 on the fixture. Disc 18 is smaller in outside diameter than disc 21, and fits through the top center opening of collar 16 defined by upper flange 17. Disc 18 is provided with a clear transparent center portion 18*a*, and disc 19 has a center portion 19*a* of a different complementary color than the remaining portion of the disc 19. Discs 19, 20 and lens 22 are of the same diameter, which is slightly less than the diameter of disc 18. The discs 18, 19, 20 and the hemispherical lens 22 are preferably made of plastic, such as acrylic, and the clear transparent disc 21 is preferably made of polycarbonate, and are assembled and adhesively secured in a stacked relationship to form the light filter and lens assembly 14 which is mounted on the end of the nipple 12 by means of the pipe union 13. The solvent used for securing the assembly of lens and discs together may, for example, be Methelyne Chloride.

The discs 18 and 19 which have center portions 18*a* and 19*a*, respectively, which are clear or of a different complementary color from the surrounding portions of the discs, and the other similar discs described hereinafter following, may be constructed in various ways. However, one manner of construction is to cut a hole in the center of a disc of one complementary color and adhesively secure, by the mentioned solvent, a disc that is clear, or of a second complementary color, and of the same size as the hole, into the hole. In some instances, where the center of the disc is clear, it may be unnecessary to insert a clear disc but rather leave the hole vacant. For rigidity of construction, light transmission, and for maintaining integrity of the filter discs, it is preferred to connect a clear disc in the center hole.

FIG. 5 illustrates one example of the colored effect provided by the light filter and lens assembly 14, wherein the center portion 18*a* of disc 18 is clear transparent, and the remaining portion is red. The center portion 19*a* of disc 19 is red while the remaining portion is blue, and the disc 20 is blue throughout. The light rays from the lamp 11 pass through the discs 21, 18, 19 and 20 into the hemispherical lens wherein the red and blue rays become mixed to impart a purple glow to the clear lens 22. The rays pass from the lens into the atmosphere to conically converge at a focal point 23 from which they continue as a conical beam split into the complementary colors of blue and red, as indicated, having a red center portion surrounded by a blue outer portion. This provides a purplish conical upwardly projecting beam from the fixture.

While the clear lens 22 imparts a purple glow, the exposed outer edges of the discs 19 and 20 will also emit basically purple light. When looking down on the fixture when lighted, the exposed outer top edge of disc 18 emits red light. The overall lighting effect produced by the light filter and lens assembly 14 is quite colorful and dramatic.

It is to be understood that other combinations of complementary light transmitting colored discs can be used to produce a desired color lighting effect.

Figure 6:
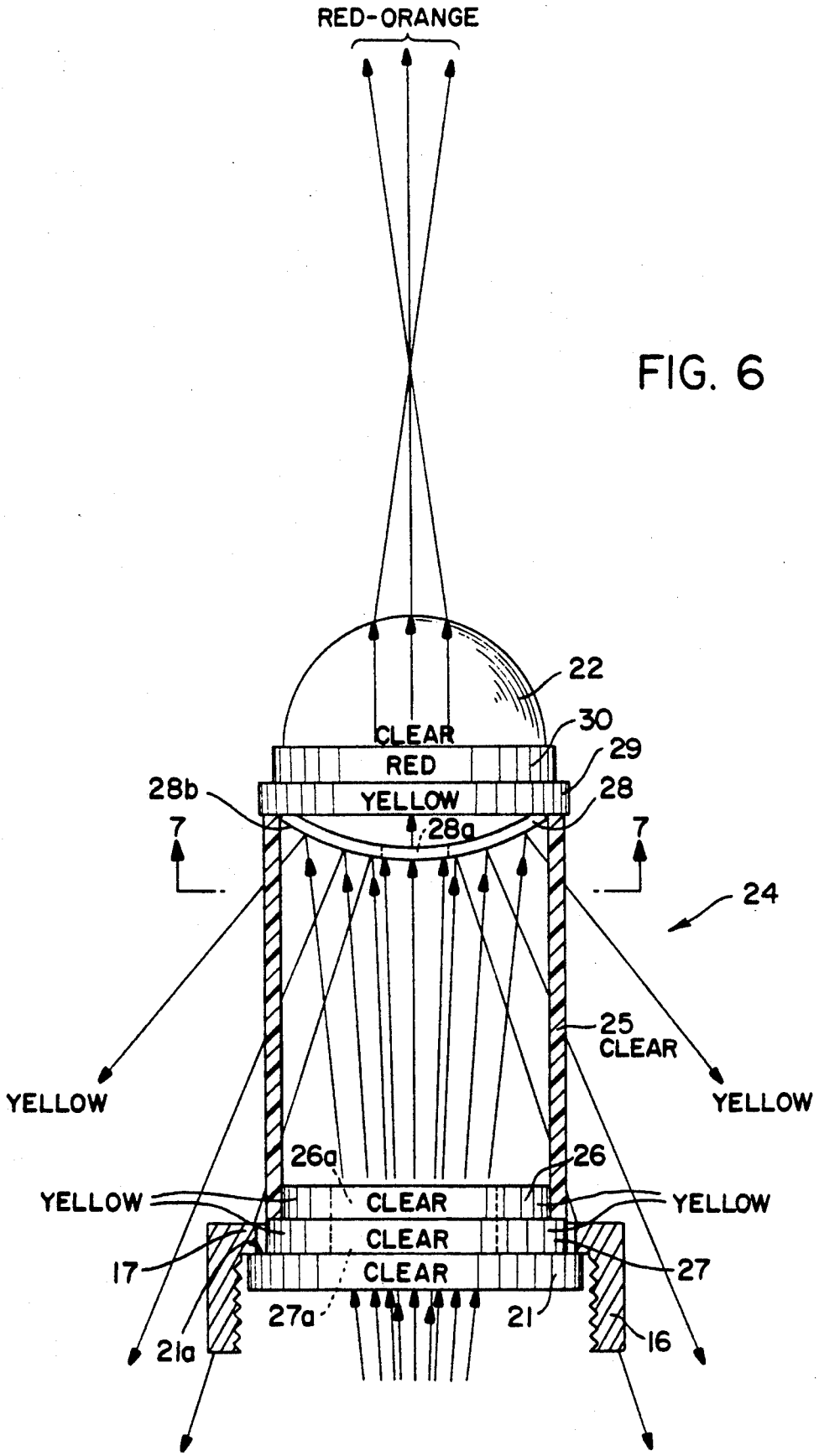
FIG. 6 is a diagrammatic view of the colored light rays emitting through another embodiment of the light filter and lens assembly.
Figure 7:
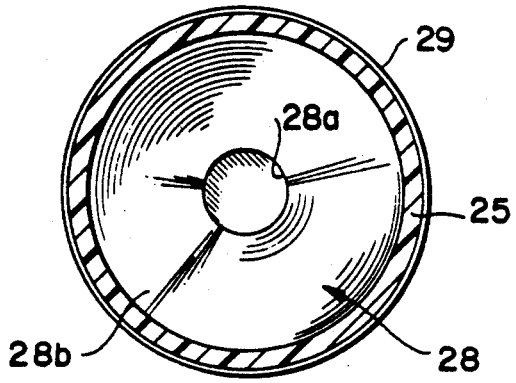
FIG. 7 is a cross-sectional view taken along line 7—7 of FIG. 6.

FIG. 6 illustrates another embodiment 24 of the light filter and lens assembly, wherein a clear transparent tube 25 has a pair of adhesively secured discs 26 and 27 adhesively secured to one end thereof, and a mirrored convex disc 28, having a central aperture 28*a*, and discs 29 and 30 adhesively secured to the opposite end thereof. The disc 27 is adhesively secured to the clear transparent disc 21, and the clear hemispherical lens 22 is adhesively secured to the disc 30, to thereby provide a filter and lens assembly adapted to be mounted as a unit on the end of the nipple 12 by means of the collar 16 threadably connected to the adaptor 15.

In the embodiment of FIG. 6 a different complementary color combination is disclosed by way of example. In this embodiment, while the disc 21 and lens 22 are clear transparent, as in the embodiment of FIG. 1, cylinder or tube 25 is also clear acrylic material, while the central portions 26*a* and 27*a* of discs 26 and 27 are clear, and the remaining portions of these two are yellow. Disc 29 is also yellow, while disc 30 is red. The light rays from the lamp 11 pass through the discs 21, 27 and 26 and into the hollow interior of the tube 25. While some of the light rays pass through the central aperture 28*a* of the downwardly facing convex disc 28, other rays are reflected off the mirrored surface 28*b* of the convex disc and are transmitted downwardly and outwardly at an angle through the wall of the tube 25 as yellow light rays directed downwardly toward the ground 2 to light the ground around the fixture. The rays which pass through the central aperture 28*a* pass through the discs 29 and 30 and into the hemispherical lens 22 wherein the red and yellow rays become mixed to impart a red-orange glow to the lens 22, and basically yellow and orange lighting of the outer edges of discs 29 and 30, respectively. The rays pass from the lens 22 directing a decorative red-orange conical beam of light upwardly into the atmosphere.

Figure 8:
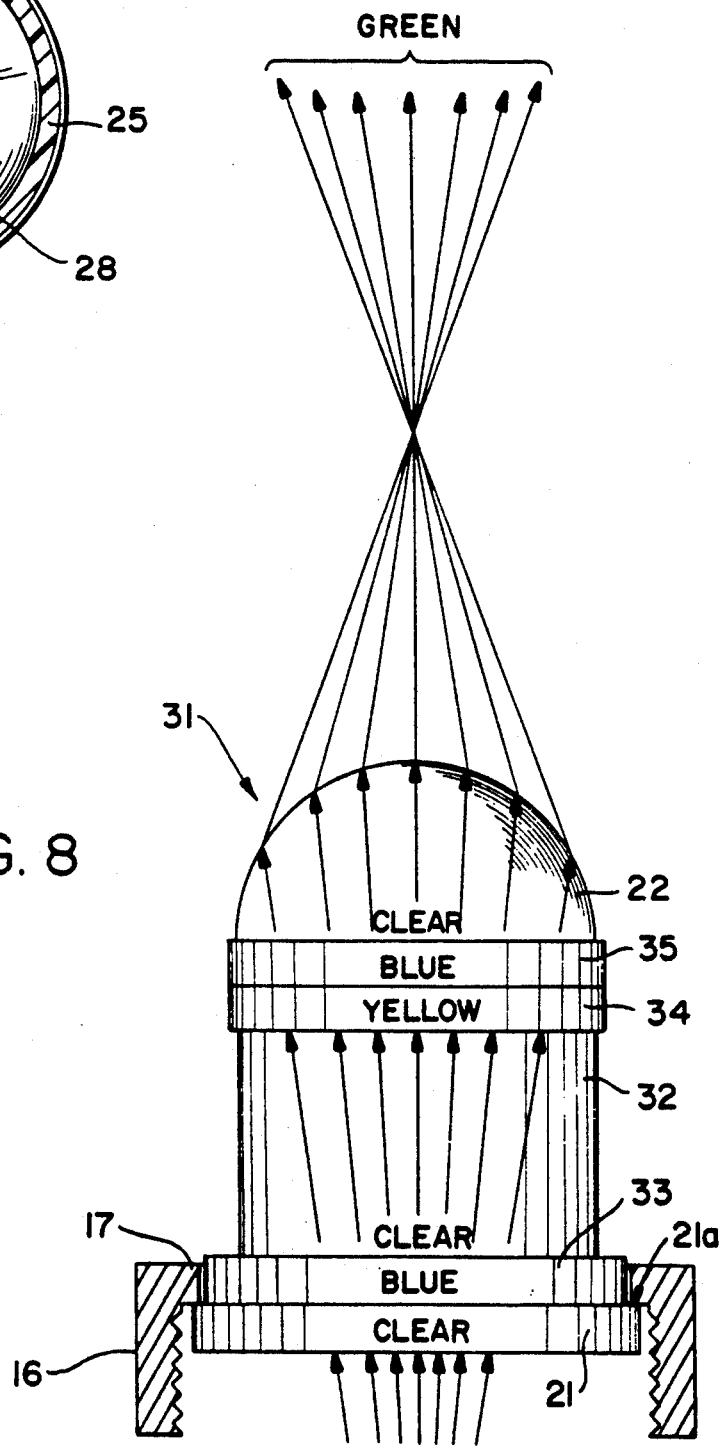
FIG. 8 is a diagrammatic view of yet another embodiment of the light filter and lens assembly.

FIG. 8 illustrates yet another embodiment 31 of the light filter and lens assembly, wherein a solid, clear transparent cylinder 32 has a blue light transmitting disc 33 bonded to the lower end thereof and a yellow light transmitting disc 34 bonded to the opposite end thereof, a blue light transmitting disc 35 being bonded to the top surface of the yellow disc 34. Once again, the clear transparent disc 21 and clear transparent hemispherical lens 22 are adhesively secured to the opposite ends of the stacked array of discs, whereby the light rays from the lamp 11 pass through the clear disc 21 and blue disc 33 to impart a blue glow to the center surface of cylinder 32, and then through the yellow and blue discs 34 and 35, respectively, to produce a green glow to the lens 22 and to thereby direct a decorative green conical beam of light upwardly into the atmosphere.

In each of the above-described embodiments of the light filter and lens assemblies, 14, 24 and 31, it will be noted that the clear transparent disc 21, upon which the remaining components of the assembly are stacked, has a larger diameter than the remaining components to thereby provide a rim portion 21*a* cooperating with the flange portion 17 of the collar 16 for holding the light filter and lens assembly on the end of the nipple 12.

The terms and expressions which have been employed herein are used as terms of description and not of limitation, and there is no intention, in the use of such terms and expressions, of excluding any equivalents of the features shown and described or portions thereof, but it is recognized that various modifications are possible within the scope of the invention claimed.

I claim:

1. A decorative outdoor light fixture comprising support means to be mounted in the ground and to extend upwardly therefrom, said support means including conduit means, electrical conductors positioned within said conduit means, an electrical socket mounted in said conduit means, the opposite ends of said electrical conductors being connected to said socket and a source of power, respectively; an upwardly facing lamp positioned in said conduit means and connected to said socket, a selected decorative light filter and lens assembly positioned on the upper end of said conduit means, and a pipe union securing said decorative light filter and lens assembly to the upper end of said conduit means, whereby each light filter and lens assembly emits a particular colored decorative light effect to the surrounding atmosphere.

2. A decorative outdoor light fixture according to claim 1, wherein each decorative light filter and lens assembly includes a laminate structure of complementary colored discs mounted in a stacked array between a transparent disc and a transparent hemispherical lens.

3. A decorative outdoor light fixture according to claim 1, wherein the selected decorative light filter and lens assembly comprises, a transparent tube having upper and lower ends, a laminate structure of a pair of colored discs and a transparent disc secured to the lower end of said transparent tube, a centrally apertured convex disc having a mirrored convex surface secured to the upper end of said transparent tube, said mirrored convex surface facing the colored discs on the lower end of said transparent tube, a second laminate structure of a pair of complementary colored discs, and a hemispherical lens secured to the upper end of said transparent tube and the convex disc on the side opposite from the mirrored surface, whereby light rays from said lamp pass upwardly through said transparent disc and said pair of colored discs into the interior of said transparent tube, some of the light rays being reflected by the mirrored surface and directed through the side of the transparent tube, other light rays passing through the apertured convex disc and through the pair of complementary colored discs and hemispherical lens to the atmosphere.

4. A decorative outdoor light fixture according to claim 1, wherein the selected decorative light filter and lens assembly comprises a solid, transparent cylinder, a complementary colored disc bonded to one end of said cylinder, a transparent disc bonded beneath said complementary colored disc, a laminate structure of a pair of complementary colored discs and a hemispherical lens bonded to the other end of said cylinder, whereby light rays from the lamp pass through the transparent disc, complementary colored disc, transparent cylinder, pair of complementary colored discs and hemispherical lens to the atmosphere.

5. A decorative outdoor light fixture according to claim 1, wherein the support means comprises a pipe adapted to extend into the ground, a pipe coupling having one end threadably secured to the upper end of said pipe, and a vertically extending nipple threadably connected to the opposite end of said nipple.

6. A decorative outdoor light fixture according to claim 5, wherein a transversely extending plate is mounted in the pipe coupling, each end of said plate having a tongue portion cooperating with the thread grooves in said coupling, whereby the plate is adjustably mounted within the coupling, said electrical socket being secured to said plate.

7. A decorative outdoor light fixture according to claim 5, wherein said vertically extending nipple has an upper end, the pipe union comprises an adaptor threadably mounted to the upper end of said nipple, and a collar having a radially inwardly turned flange threadably connected to the adaptor.

8. A decorative outdoor light fixture according to claim 1, wherein said pipe union includes a collar with a radially inwardly directed flange, each decorative light filter and lens assembly has at least one complementary colored disc bonded to the upper surface of a transparent disc, the diameter of the transparent disc being greater than the diameter of the colored disc to thereby provide a rim portion on the transparent disc cooperating with said flange on said collar for holding the light filter and lens assembly on the end of said conduit means.

9. A decorative outdoor light fixture according to claim 8, including at least a second colored disc of a second complementary color bonded to the upper surface of said at least one complementary colored disc, and a transparent hemispherical lens connected above said at least a second colored disc.

10. A decorative outdoor light fixture according to claim 8, including a second colored disc of a second complementary color bonded to the upper surface of said at least one complementary colored disc, a third colored disc of said second complementary color bonded to the upper surface of said second colored disc, and a transparent hemispherical lens bonded to the upper surface of said third colored disc.

11. A decorative outdoor light fixture according to claim 10, wherein said second colored disc of said second complementary color includes a center portion having the complementary color of said at least one complementary colored disc.

12. A decorative outdoor light fixture according to claim 10, wherein said at least one complementary colored disc has a clear center portion, said second colored disc of said second complementary color includes a center portion having the complementary color of said at least one complementary colored disc.

13. A decorative outdoor light fixture according to claim 8, wherein said at least one complementary colored disc is positioned adjacent said radially inwardly directed flange.

14. A decorative outdoor light fixture according to claim 8, including a transparent tube having upper and lower ends, a second colored disc having the complementary color of said at least one complementary colored disc connected to the upper surface of said at least one complementary colored disc and to the lower end of said transparent tube, a convex disc having a central aperture and a mirrored convex surface connected to the upper end of said transparent tube, said mirrored convex surface facing the lower end of said transparent tube, a third colored disc of the complementary color of said at least one complementary colored disc connected to the upper end of said transparent tube, a fourth colored disc of a second complementary color connected to the upper surface of said third colored disc; and a hemispherical lens connected to the upper surface of said fourth colored disc.

15. A decorative outdoor light fixture according to claim 14, wherein said at least one complementary colored disc and said second colored disc each have a clear center portion.

16. A decorative outdoor light fixture according to claim 8, including a transparent cylinder connected to the upper surface of said at least one complementary colored disc, a second colored disc of a second complementary color connected to the upper surface of said transparent cylinder, a third colored disc having the complementary color of said at least one complementary colored disc connected to the upper surface of said second colored disc, and a transparent hemispherical lens connected to the upper surface of said third colored disc.

* * * * *